US008632198B2

(12) United States Patent
Ruud et al.

(10) Patent No.: US 8,632,198 B2
(45) Date of Patent: Jan. 21, 2014

(54) FLEXIBLE LED LIGHTING SYSTEMS, FIXTURES AND METHOD OF INSTALLATION

(75) Inventors: Alan J. Ruud, Racine, WI (US); Wayne P. Guillien, Franksville, WI (US); David G. Jansson, Racine, WI (US)

(73) Assignee: Cree, Inc., Durham, NC (US)

( * ) Notice: Subject to any disclaimer, the term of this patent is extended or adjusted under 35 U.S.C. 154(b) by 40 days.

(21) Appl. No.: 13/491,123

(22) Filed: Jun. 7, 2012

(65) Prior Publication Data

US 2013/0141893 A1 Jun. 6, 2013

Related U.S. Application Data

(63) Continuation of application No. 12/175,600, filed on Jul. 18, 2008, now Pat. No. 8,197,079.

(60) Provisional application No. 60/950,567, filed on Jul. 18, 2007.

(51) Int. Cl.
*F21V 33/00* (2006.01)

(52) U.S. Cl.
USPC ..... 362/85; 362/249.02; 362/249.04; 362/295; 362/147; 315/291; 315/312

(58) Field of Classification Search
USPC ..... 362/85, 295, 249.02, 249.04, 249.05, 362/147; 315/291, 312; 439/110–112, 115
See application file for complete search history.

(56) References Cited

U.S. PATENT DOCUMENTS

| | | | | |
|---|---|---|---|---|
| 4,177,502 | A * | 12/1979 | Hiscock | 362/218 |
| 4,367,417 | A | 1/1983 | Casasanta | |
| 4,667,133 | A | 5/1987 | Nilssen | |
| 5,008,595 | A | 4/1991 | Kazar | |
| 5,577,832 | A | 11/1996 | Lodhie | |
| 5,580,155 | A | 12/1996 | Hildebrand et al. | |
| 5,661,374 | A | 8/1997 | Cassidy et al. | |
| 5,803,579 | A | 9/1998 | Turnbull et al. | |
| 6,016,038 | A | 1/2000 | Mueller et al. | |
| 6,150,774 | A | 11/2000 | Mueller et al. | |
| 6,161,496 | A | 12/2000 | Fulks | |
| 6,166,496 | A | 12/2000 | Lys et al. | |
| 6,283,612 | B1 | 9/2001 | Hunter | |
| 6,340,868 | B1 | 1/2002 | Lys et al. | |
| 6,346,777 | B1 | 2/2002 | Kim | |
| 6,392,368 | B1 | 5/2002 | Deller et al. | |
| 6,424,248 | B1 | 7/2002 | Toms et al. | |
| 6,459,919 | B1 | 10/2002 | Lys et al. | |
| 6,505,958 | B2 | 1/2003 | Ooms et al. | |
| 6,528,954 | B1 | 3/2003 | Lys et al. | |
| 6,540,373 | B2 | 4/2003 | Bailey | |

(Continued)

FOREIGN PATENT DOCUMENTS

DE 29711379 U1 6/1997

*Primary Examiner* — Ali Alavi
(74) *Attorney, Agent, or Firm* — Jansson Munger McKinley & Shape Ltd.

(57) ABSTRACT

A low-voltage LED lighting system, LED lighting fixtures, and a method for installation thereof in which the system includes: (a) at least one LED lighting fixture each having one or more LEDs; (b) at least one remotely-located power driver; and (c) interconnections between the at least one LED fixture and the at least one driver using communication network cabling and standard 8P8C network connectors. Preferred lighting fixtures are recessed lighting fixtures adapted for ceiling mounting.

17 Claims, 12 Drawing Sheets

(56) References Cited

U.S. PATENT DOCUMENTS

| | | | | |
|---|---|---|---|---|
| 6,548,967 | B1 * | 4/2003 | Dowling et al. | 315/318 |
| 6,597,179 | B2 | 7/2003 | St-Germain | |
| 6,600,324 | B2 | 7/2003 | St-Germain | |
| 6,608,453 | B2 | 8/2003 | Morgan et al. | |
| 6,608,485 | B2 | 8/2003 | St-Germain | |
| 6,624,638 | B2 | 9/2003 | St-Germain | |
| 6,720,745 | B2 | 4/2004 | Lys et al. | |
| 6,762,563 | B2 | 7/2004 | St-Germain et al. | |
| 6,764,196 | B2 | 7/2004 | Bailey | |
| 6,781,329 | B2 | 8/2004 | Mueller et al. | |
| 6,788,011 | B2 | 9/2004 | Mueller et al. | |
| 6,806,659 | B1 | 10/2004 | Mueller et al. | |
| 6,869,204 | B2 | 3/2005 | Morgan et al. | |
| 6,936,978 | B2 | 8/2005 | Morgan et al. | |
| 6,965,205 | B2 | 11/2005 | Piepgras et al. | |
| 6,967,448 | B2 | 11/2005 | Morgan et al. | |
| 6,995,355 | B2 | 2/2006 | Rains, Jr. et al. | |
| 7,014,336 | B1 | 3/2006 | Ducharme et al. | |
| 7,038,399 | B2 | 5/2006 | Lys et al. | |
| 7,042,172 | B2 | 5/2006 | Dowling et al. | |
| 7,064,498 | B2 | 6/2006 | Dowling et al. | |
| 7,102,172 | B2 | 9/2006 | Lynch et al. | |
| 7,145,125 | B2 | 12/2006 | May et al. | |
| 7,148,470 | B2 | 12/2006 | Rains, Jr. et al. | |
| 7,161,313 | B2 | 1/2007 | Piepgras et al. | |
| 7,186,003 | B2 | 3/2007 | Dowling et al. | |
| 7,187,141 | B2 | 3/2007 | Mueller et al. | |
| 7,202,613 | B2 | 4/2007 | Morgan et al. | |
| 7,204,622 | B2 | 4/2007 | Dowling et al. | |
| 7,309,965 | B2 * | 12/2007 | Dowling et al. | 315/318 |
| 7,880,663 | B2 * | 2/2011 | Chiu | 341/173 |
| 2001/0022301 | A1 | 9/2001 | O'Donnell | |
| 2002/0014867 | A1 | 2/2002 | Callahan | |
| 2002/0086567 | A1 | 7/2002 | Cash, Jr. | |
| 2003/0057884 | A1 | 3/2003 | Dowling et al. | |
| 2003/0137258 | A1 | 7/2003 | Piepgras et al. | |
| 2004/0105264 | A1 | 6/2004 | Spero | |
| 2004/0164619 | A1 | 8/2004 | Parker et al. | |
| 2004/0207341 | A1 | 10/2004 | Callahan | |
| 2004/0212993 | A1 | 10/2004 | Morgan et al. | |
| 2005/0062446 | A1 | 3/2005 | Ashdown | |
| 2005/0122065 | A1 | 6/2005 | Young | |
| 2005/0122705 | A1 | 6/2005 | Pohlert et al. | |
| 2005/0128751 | A1 | 6/2005 | Roberge et al. | |
| 2005/0169015 | A1 | 8/2005 | Luk et al. | |
| 2005/0236998 | A1 | 10/2005 | Mueller et al. | |
| 2005/0285547 | A1 | 12/2005 | Piepgras et al. | |
| 2006/0002110 | A1 | 1/2006 | Dowling et al. | |
| 2006/0070763 | A1 | 4/2006 | Herth | |
| 2006/0267028 | A1 | 11/2006 | Lynch et al. | |
| 2007/0008710 | A1 | 1/2007 | Nielson et al. | |
| 2007/0045524 | A1 | 3/2007 | Rains, Jr. et al. | |
| 2008/0197790 | A1 | 8/2008 | Mangiaracina et al. | |

* cited by examiner

38

| Input pin | Mode 1 | Mode 2 | Mode 3 | Mode 4 |
|---|---|---|---|---|
| $S_{a1}$ | $P_{a1}$ | $S_{a2}$ | $S_{a2}$ | $S_{a2}$ |
| $S_{a2}$ | $P_{a2}$ | $S_{a2}$ | $S_{a2}$ | $S_{a2}$ |
| $S_{b1}$ | $P_{b1}$ | - | $P_{a1}$ | $P_{a1}$ |
| $S_{b2}$ | $P_{b2}$ | - | $P_{a2}$ | $P_{a2}$ |
| $S_{c1}$ | $P_{c1}$ | - | $P_{b1}$ | $Q_{a1}$ |
| $S_{c2}$ | $P_{c2}$ | - | $P_{b2}$ | $Q_{a2}$ |
| $S_{d1}$ | $P_{d1}$ | - | $P_{c1}$ | $R_{a1}$ |
| $S_{d2}$ | $P_{d2}$ | - | $P_{c2}$ | $R_{a2}$ |

FLEXIBLE LED LIGHTING SYSTEMS, FIXTURES AND METHOD OF INSTALLATION

RELATED APPLICATION

This application is a continuation of patent application Ser. No. 12/175,600, filed Jul. 18, 2008, now U.S. Pat. No. 8,197,079. The contents of the parent application are incorporated herein by reference. This application claims the benefit of Provisional Patent Application Ser. No. 60/950,567, filed Jul. 18, 2007, the contents of which are incorporated herein by reference.

FIELD OF THE INVENTION

This invention is related generally to lighting systems, and more particularly to LED-based low-voltage lighting systems and fixtures for such systems.

BACKGROUND OF THE INVENTION

There is continuing pressure for the reduction of overall power consumption and movement toward "green" technologies within the lighting industry. This invention is directed toward meeting the demands of both of these ideals in the area of general lighting through the use of LED-based luminaire systems. The invention is a complete LED lighting system that makes innovative use of new LED technology and low-voltage, remotely-located power drivers/controllers and commonly-available communication network cabling and the corresponding standard connectors used with such cabling. Communication network cabling, typically comprising four twisted pairs of conductors, has become a low-cost commodity item as have the standard connectors used with such cabling. Because the voltage used in such cabling (and power units connected thereto) is low-voltage, the skill level (and cost per hour) of the installers is low, providing strong incentive for utilization of such a cost-effective system. Also, the ease of interconnection available with the standard network connectors further reduces the time required for installation.

The resultant lighting systems can provide at least 50% reduction in power consumption aggregately over current lighting systems, with an efficient, consistent and uniform realized lumen output. Adoption of this approach by an end-user reduces initial installation costs by using simple cable feeds without the need of conduit and by exploiting the quick-connection aspects of the standard connectors. By using LEDs with, for example, a 50,000 hour (minimum) maintenance-free life, the inventive lighting system provides superior installation simplicity and system performance using a comparatively "green" technology with a substantial reduction in "total-cost-of-ownership per unit area of application space" for the end-user.

OBJECTS OF THE INVENTION

It is an object of this invention, in the field of lighting systems, to provide LED lighting systems which substantially reduce the total-cost-of-ownership per unit area of application space served for the end-user.

Another object of this invention is to provide LED lighting systems which utilize only communication network cabling and standard network connectors for system connections.

Another object of this invention is to provide LED lighting systems which limit the power driver output voltage and power to the limits prescribed by the Class 2 power supply standards.

Another object of this invention is to provide LED lighting systems which are flexible and reconfigurable.

Another object of this invention is to provide LED lighting systems which utilize only a small number of elements which, when interconnected, permit a wide variety of lighting system architectures.

Another object of this invention is to provide LED lighting systems which require a low skill level for the installers of the systems.

These and other objects of the invention will be apparent from the following descriptions and the drawings.

SUMMARY OF THE INVENTION

The term "shift module" as used herein describes a building block used within the inventive LED lighting system to shift the connections of an input network connector of a shift module in order to enable the driver initially connected to one conductor pair within a connected cable to be connected to another position in an output network connector of the shift module. Details of a shift module are further described below.

The term "star module" as used herein describes a building block used within the inventive LED lighting system to distribute the connections of an input network connector of a star module to multiple output network connectors of a star module in order to enable the drivers initially connected to the conductor pairs of the connected input cable to each be connected to a separate output network connector. Details of a shift module are further described below.

The term "terminated" as used herein describes an LED fixture in which the pair of conductors which is connected to the LEDs of the fixture is shorted, e.g., with a jumper or switch, at the output side of the LED fixture to allow electrical current to flow through the conductor pair. Further detail on such termination is described below.

The term "communication network cabling" as used herein refers to the commonly-available network cabling consisting of multiple pairs of conductors. For example, very commonly used Category 5 (and Category 5e) cabling includes four twisted pairs of conductors. Other communication network cabling, such as Category 2 and Category 6 cabling, is also intended to be described by the term "communication network cabling" as used herein, as is other low-voltage, multi-pair cabling with either twisted or non-twisted pairs. The most common standard cable, Category 5 (or 5e) cabling, is often referred to as Cat 5 cable.

The term "standard network connectors" as used herein refers to the network cable connectors used as connectors for communication network cabling. For example, connectors typically used with Cat 5 cabling are often referred to as RJ45 connectors. More generally, four-conductor-pair cabling uses connectors referred to as 8P8C connectors. The standard shape and dimensions of standard 8P8C network connectors are specified by the Administrative Council for Terminal Attachment (ACTA) in national standard ANSI/TIA-968-A. Standard 8P8C network connectors come in two forms, a male plug and a female socket. The connectors used with communication network cabling having other than four conductor pairs are also intended to come under the descriptor "standard network connectors" as used herein.

The term "DIP switches" as used herein refers to dual in-line package switches well known to those skilled in the art of circuit design.

The invention disclosed herein is a low-voltage LED lighting system comprising (a) at least one LED lighting fixture each having one or more LEDs, (b) at least one power driver remote from the fixture(s), and (c) interconnections between the at least one fixture and the at least one power driver using communication network cabling and standard network connectors.

In certain embodiments of the inventive LED lighting system, the at least one fixture has a plurality of LEDs connected in series.

In some embodiments, the interconnections include at least one shift module paired with a fixture. In other embodiments, the interconnections include at least one star module paired with a fixture.

Some embodiments of the inventive LED lighting system include at least one fixture which is terminated.

In certain highly advantageous embodiments of the inventive LED lighting system, each of the power drivers has a Class 2 output voltage limit of 60 volts and a Class 2 output power limit of 100 watts.

In certain other embodiments of the inventive LED lighting system, at least one of the fixtures further includes an input standard network connector having input connector contacts, a plurality of output standard network connectors each having output connector contacts, and an array of switches which are configured to selectively interconnect the input contacts and output contacts. In some embodiments, the array of switches comprises DIP switches.

In certain highly useful embodiments of the inventive LED lighting system, the fixture(s) are recessed fixtures adapted for ceiling mounting.

The present invention is also a method of installing a low-voltage LED lighting system, the method comprising (a) providing at least one LED lighting fixture each having one or more LEDs, (b) providing at least one power driver, (c) installing the driver(s) at positions remote from the fixture(s), and (d) interconnecting the fixture(s) and the driver(s) using communication network cabling and standard network connectors, thereby facilitating efficient lighting system installation with low man-hour requirements and low installer skill levels. In certain embodiments of the inventive method, recessed fixtures adapted for ceiling mounting are provided. Another aspect of the invention disclosed herein is a low-voltage LED lighting fixture comprising: (a) at least one LED light source; (b) a standard network input connector having plural contact pairs; (c) at least one standard output connector having the same number of contact pairs as the input connector; and (d) an interconnection network configured to flexibly change the interconnections between the input connector and the at least output connector.

In certain embodiments of the inventive low-voltage LED lighting fixture, the interconnection network is configured to provide low-voltage power to the at least one LED light source and to connect each contact pair of the input connector to its corresponding contact pair of one output connector.

In certain other embodiments, the interconnection network is configured to provide low-voltage power to the at least one LED light source and to short the conductors powering the LED light source. In some such embodiments, (a) the fixture includes one fewer output connectors than the number of contact pairs of the input connector; (b) the input connector and each of the output connectors each have a primary contact pair, the primary contact pair of the input connector providing the power to the at least one LED light source; and (c) the interconnection network is configured to (1) connect one non-primary pair of input connector contacts to the primary pair of output connector contacts on one output connector and (2) connect each remaining input connector contact pair only to a respective one of the remaining output connector contact pairs. In other such embodiments, (a) the fixture includes one fewer output connectors than the number of contact pairs of the input connector; (b) the input connector and each of the output connectors each have a primary contact pair, the primary contact pair of the input connector providing the power to the at least one LED light source; and (c) the interconnection network is configured to connect each non-primary input connector contact pair to a respective one of the primary pairs of an output connector.

In highly advantageous embodiments of the inventive low-voltage LED lighting fixture, the fixture is a recessed fixture adapted for ceiling mounting.

In certain embodiments, the interconnection network is an array of switches. In some of such embodiments, the switches of the array are DIP switches.

In certain other embodiments of the inventive low-voltage LED lighting fixture, one of the input connector contact pairs is connected to conductors which carry data to control the fixture and the interconnection network includes a unique address associated with the fixture.

In descriptions of this invention, including in the claims below, the terms "comprising," "including" and "having" (each in their various forms) and the term "with" are each to be understood as being open-ended, rather than limiting, terms.

BRIEF DESCRIPTION OF THE DRAWINGS

FIG. 2A is a schematic of an LED lighting fixture; FIG. 2B is a schematic of a shift module; and FIG. 2C is a schematic of a star module.

FIG. 3A is a schematic of Mode 1 operation, with an LED lighting fixture which in series with, for example, a neighboring fixture connected to its output and passing other driver lines through the fixture.

FIG. 3B is a schematic of Mode 2 operation, with an LED lighting fixture located at the end of a driver line and passing other driver lines through the fixture.

FIG. 3C is a schematic of Mode 3 operation, with an LED lighting fixture at the end of a driver line and using a shift module to shift other driver lines for connections to additional LED fixtures.

FIG. 3D is a schematic of Mode 4 operation, with and LED lighting fixture at the end of a driver line with other driver lines being connected to separate connectors through the use of a star module.

DETAILED DESCRIPTION OF PREFERRED EMBODIMENTS

The basic features of the inventive LED lighting system are the use of communication network cabling with standard network connectors as the interconnecting elements of the system and the use of power drivers which are Class 2 units (i.e., having output of low voltage and low power).

The fundamental features and the performance parameters of LED light sources translate into certain limitations imposed on the configuration of the fixtures and systems. For example, with a voltage drop of about 3.15 volts across each LED, a maximum of 18 LEDs in series are able to be driven by a driver limited by the Class 2 voltage limit of 60 volts. (A small line voltage drop is assumed in this calculation.) 18 LEDs in series consume about 20 watts (@350 ma current), well below the 100 watt Class 2 power limitation. On the other hand, 18 LEDs with a luminous efficacy of, say, 90 lumens per watt, will provide illumination of about 1780 lumens. In many applications, such a fixture may have much higher light output than the specific application requires in a single fixture. Fixtures having both fewer or more LEDs than the exemplary fixture are possible without bumping up against the Class 2 limitations, and it is, of course, also possible to drive fixtures at a higher current level than the example of 350 ma.

LED lighting systems which include recessed lighting fixtures adapted for ceiling mounting are particularly well suited to benefit from the advantages provided by this inventive LED system. Recessed lighting fixtures mounted in or on ceilings require considerable amount of skilled electrical work for installation. With the inventive system, power drivers and fixtures are simply interconnected with standard communication network cabling and standard network connectors which snap in and out easily and quickly and are held positively in place. The inventive system dramatically reduces the amount of electrical work requiring skilled electricians when compared to the installation of standard recessed lighting systems. FIGS. 5-8 illustrate LED lighting fixtures which are adapted for ceiling mounting. A co-owned pending U.S. patent application Ser. No. 12/173,721, entitled "Lens with TIR for Off-Axis Light Distribution" also discloses recessed LED lighting fixtures which can be included in the inventive lighting system disclosed herein.

Figure 1:
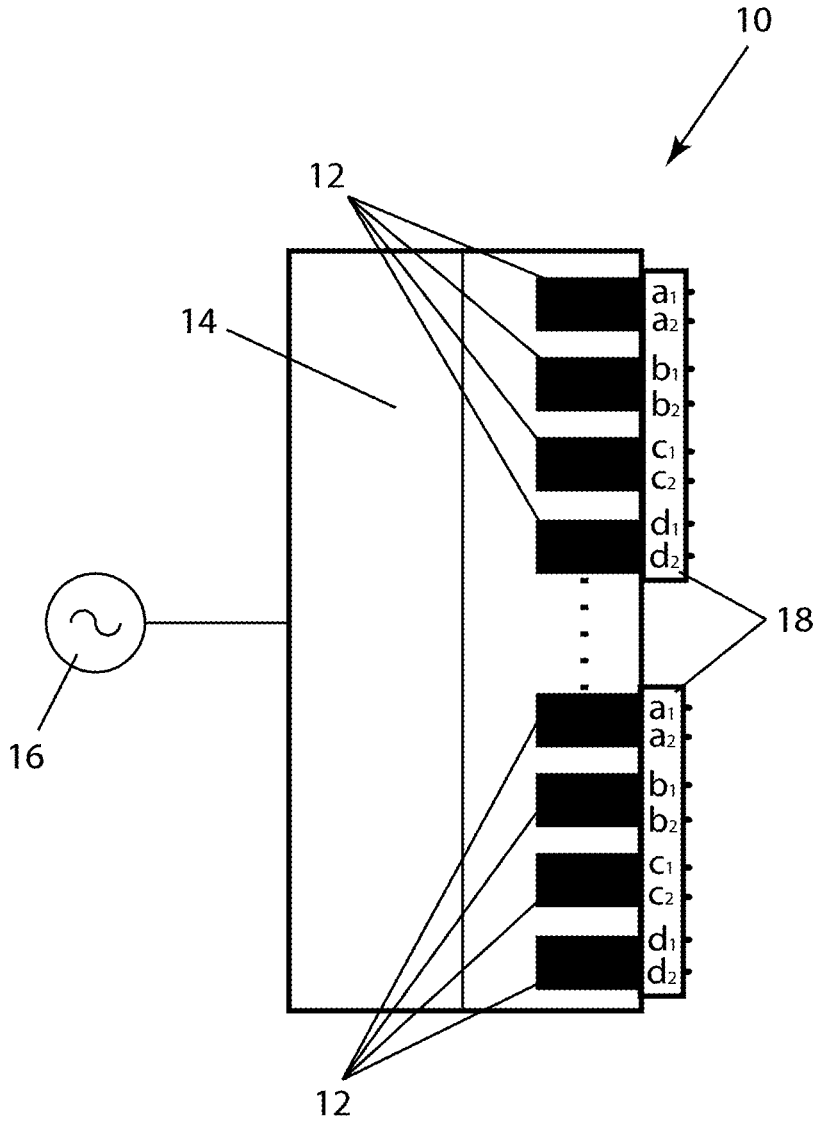
FIG. 1 is a schematic of a control unit according to this invention.

The general structure of the inventive LED lighting system is described below, referring to the figures which have been described briefly above. FIG. 1 schematically illustrates a remote unit 10 including an DC power supply and controller 14 supplied with AC power from an AC power source 16, and low-voltage driver modules 12 (eight shown) which each drive one or more LED fixtures 20 (shown in various forms in FIGS. 2A-3D and 5-13 and with other reference numbers when describing particular lighting fixture configurations) with DC power through communication network cabling 62 (shown in FIG. 9) which interconnects each element of the lighting system using standard communication network connectors 18. Drivers 12 provide DC power which is current-controlled, providing constant current through the LEDs in each LED fixture 20 with current levels typically of at least 350 ma. Such commonly-available power sources are well-known to those skilled in the state of the art of circuit design.

Power supply and controller 14 provides power of up to 100 watts per channel (per conductor pair in the cabling), with a voltage limit of 60 volts for dry applications and 30 volts for wet applications. However, for a variety of design reasons, it is unlikely that any single driver 12 will be operating at this maximum allowable Class 2 power level.

Power supply and controller 14 may include the ability to dim each LED fixture 20 connected thereto individually with separate manual dimmer controls (not shown) or all together with a single manual dimmer control. Control of fixtures 20 may also be carried out through a programmable portion of power supply and controller 14.

In the embodiments used to illustrate the inventive LED lighting systems herein, standard connectors 18 each have four pairs of contacts indicated as $a_1a_2$, $b_1b_2$, $c_1c_2$, and $d_1d_2$, respectively. In each of the figures herein (except in the embodiment of alternative fixture 64 of FIG. 10), contact pair $a_1a_2$ is shown as the pair of contacts connected to the pair of conductors within which the LEDs of the LED fixture are contained. This pair of conductors is sometimes referred to herein as the primary pair of conductors. However, it should be noted that in many circumstances, it is not necessary that the pair of conductors to which $a_1a_2$ are connected be the primary pair of conductors or channel.

Figure 2A:
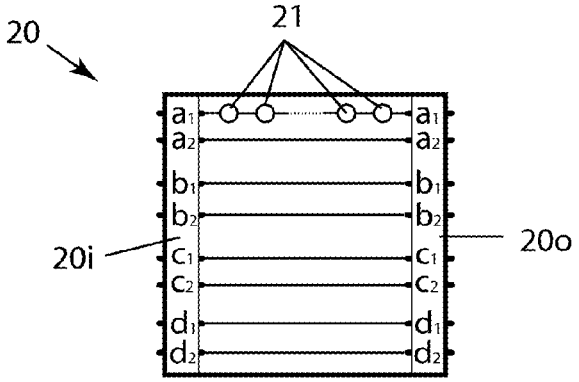
FIGS. 2A-2C are schematics of a set of building blocks describing the basic functions of fixtures and connecting modules according to this invention.
Figure 2B:
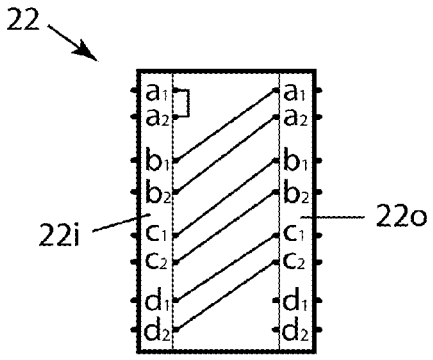
Figure 2C:
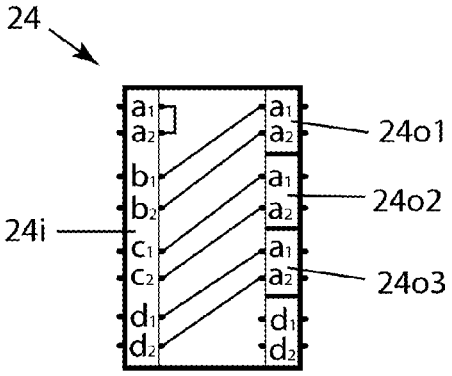

FIGS. 2A-2C schematically illustrate a set of building blocks which provide the interconnect functions needed to create a wide variety of lighting systems architectures for the inventive LED lighting system. Each of these illustrations is schematic in nature since the circuit configurations required to achieve these functions is clearly described by the schematics; the circuitry required to perform these functions is readily known by those skilled in the art of circuit design. Using these building blocks, a wide variety number of LED lighting system architectures is possible.

Each of these building blocks includes a single standard network connector as an input connector and a single standard network connector as an output connector. Input connectors are indicated by appending an "i" to the corresponding reference number. An "o" is similarly appended to indicate an output connector. Such a single-input, single-output connector embodiment is only by way of example and not intended to limit the variations of building block possible under the inventive system disclosed herein. For example, LED fixture 20 of FIG. 2A has input connector 20*i* and output connector 20*o* and includes LEDs 21. Many alternatives are illustrated using fixtures having a single series of LEDs in the fixture connected to the primary pair of conductors, in the illustrations all labeled as the conductor pair connected to connector contacts $a_1a_2$, as shown in FIG. 2A. Fixture configurations are not limited to this single pair of conductors approach, but it is expected that for practical reasons, such an approach may be advantageous. (For simplicity, conductor pairs and contact pairs are herein often referred to by the pair of subscripted letters indicating the contact pair to which the pair of conductors is connected.)

FIGS. 2B and 2C illustrate two building blocks which optionally may be connected to LED fixtures 20 in order to configure an array of fixtures in a desired fashion to create an LED lighting system. The first of these is a shift module 22 shown in FIG. 2B. Shift module 22 shifts the connections of conductor pairs within input connector 22*i* as shown, thus enabling the driver initially connected to connector pair positions other than that denoted by $a_1a_2$ to be connected to subsequent lighting fixtures by connecting to different pairs of connections within output connector 22*o*.

The second of the two building blocks is called a star module 24 (FIG. 2C), so named since it has one input connector 24*i* and three output connectors 24*o*1, 24*o*2, and 24*o*3, thus allowing "star" configurations of fixtures 20 to be created.

Figure 3A:
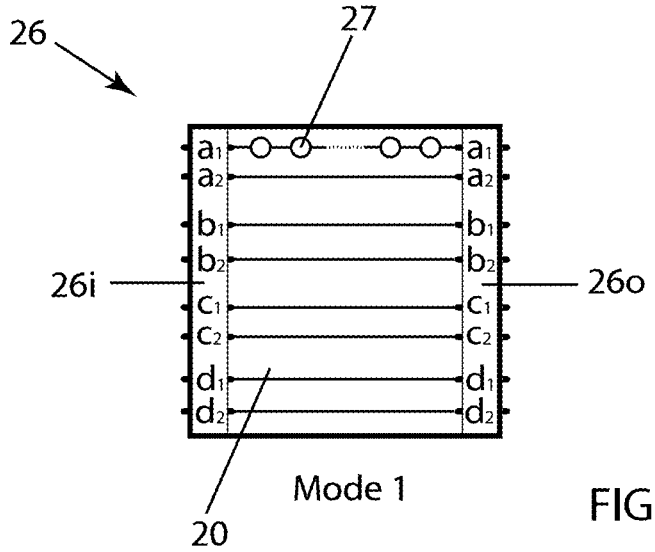
FIGS. 3A-3D are schematics of the functional building blocks representing the set of four basic operational modes of fixtures and connections to provide interconnectivity capable of a wide range of lighting system architectures, of which the schematic of FIG. 9 is one example.

Arrays of lighting fixtures 20 can be configured using these building block elements which can also represent physical building blocks for the lighting systems. The functions which are achieved by the use of these building blocks are illustrated in FIGS. 3A-3D. The four basic functions are referred to as operational modes. The fixture 26 of FIG. 3A is in operational Mode 1. Fixture 26 simply passes each of the four pairs of conductors through fixture 26 with the LEDs 27 (four shown) connected in series in the primary pair of conductors $a_1a_2$.

Figure 3B:
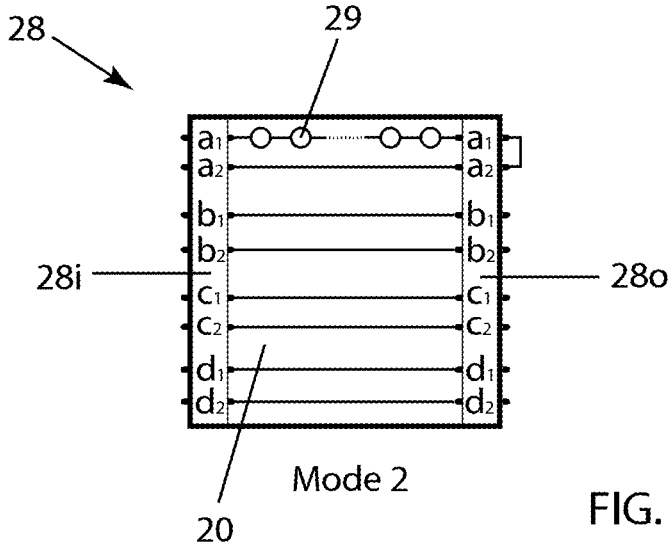

FIG. 3B illustrates operational Mode 2 in which a fixture 28 is simply at the end of a conductor pair, driven by the power driver (not shown) which is connected to the primary pair of conductors of the input connector 28*i*. Fixture 28 may be the only fixture thus connected or may be at the end of a chain of fixtures driven by a single power driver. The pair of connections $a_1a_2$ of the output connector 28*o* are connected together to cause the electrical current to flow through the primary conductor pair. Such a fixture 28 is said to be terminated. A manual end-of-chain switch 49 illustrated in FIG. 6 (or a simple jumper) can be used to provide such termination.

Figure 3C:
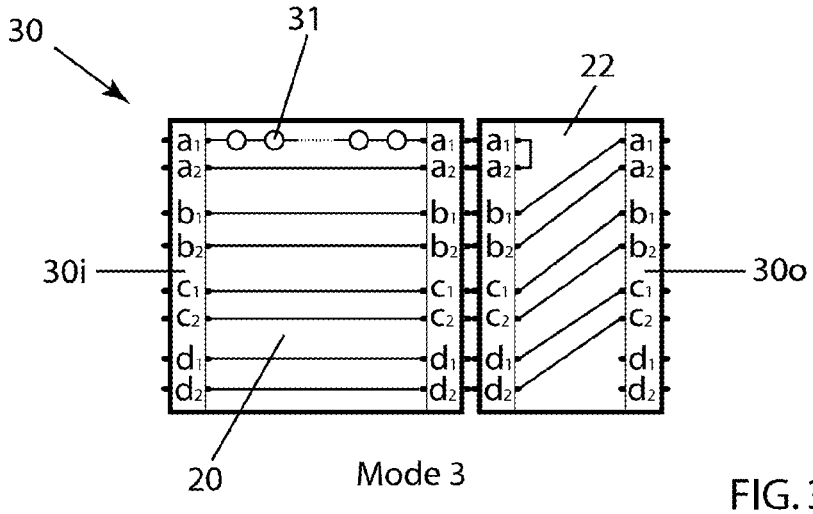
Figure 3D:
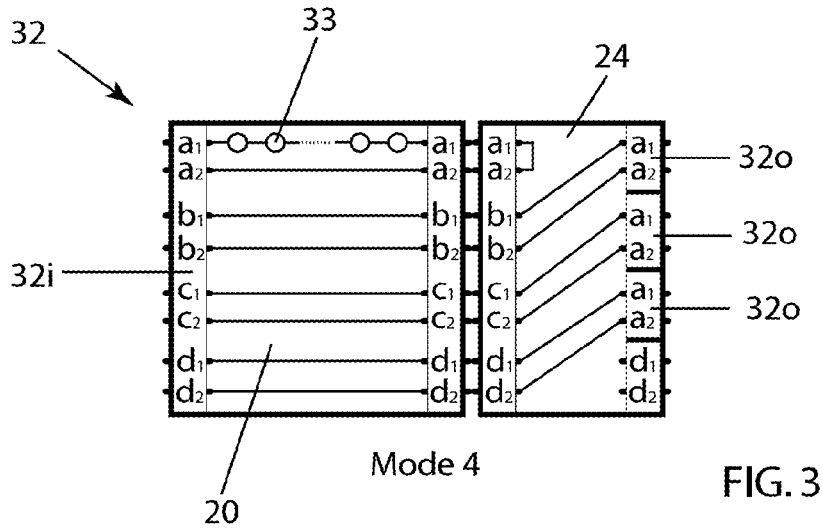

FIG. 3C illustrates operational Mode 3, in which the primary pair is terminated in shift module 22 and the second through fourth pairs are each shifted one position within output connector 30*o*. Operational mode 4, shown in FIG. 3D, describes connections which places the incoming pairs of conductors in position to drive fixtures connected downstream to other fixtures or an array of fixtures through output connectors 32*o* (three shown).

Figure 9:
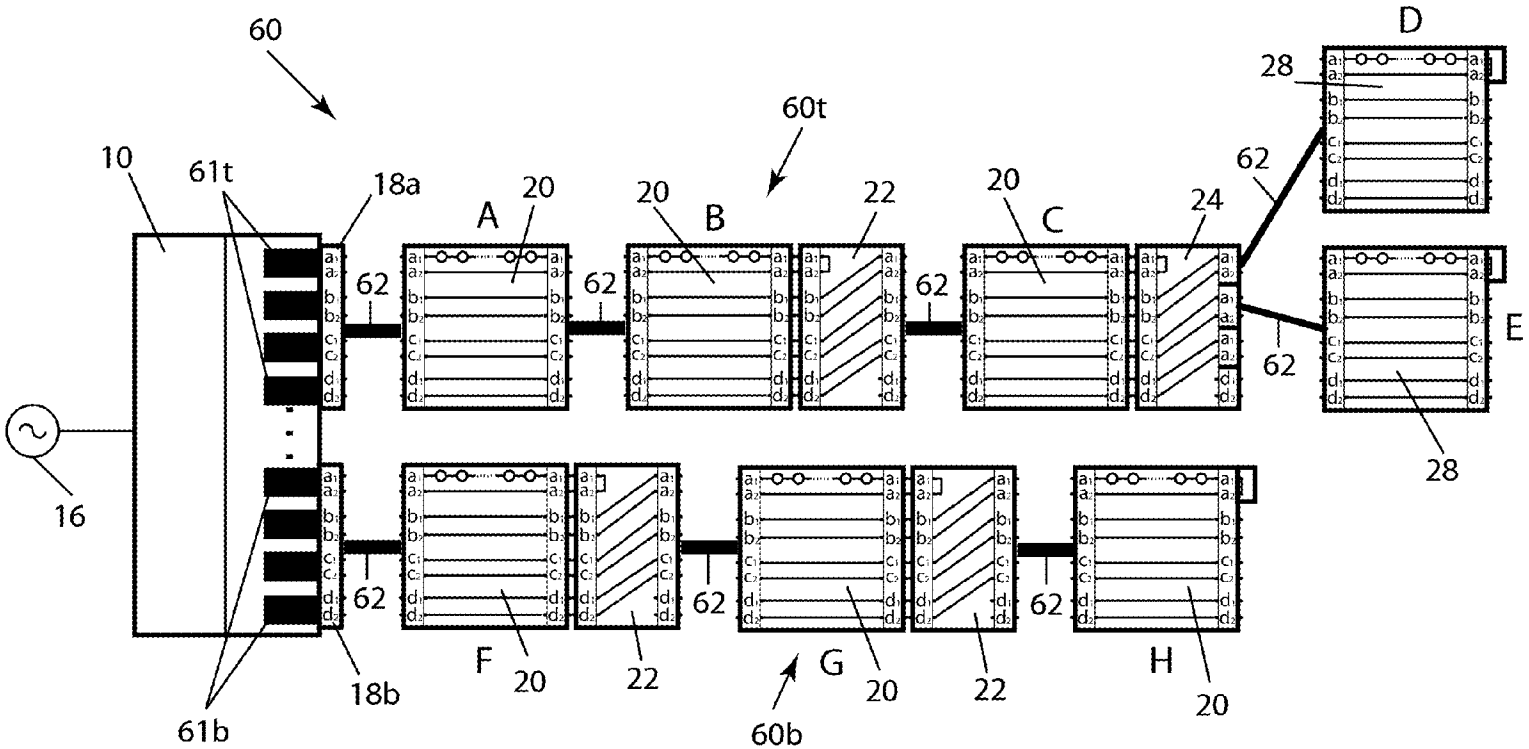
FIG. 9 is a schematic of an example system of LED lighting fixtures according to this invention.

One example of an LED lighting system configured by combining these building blocks and operational modes is illustrated schematically in FIG. 9.

Figure 4A:
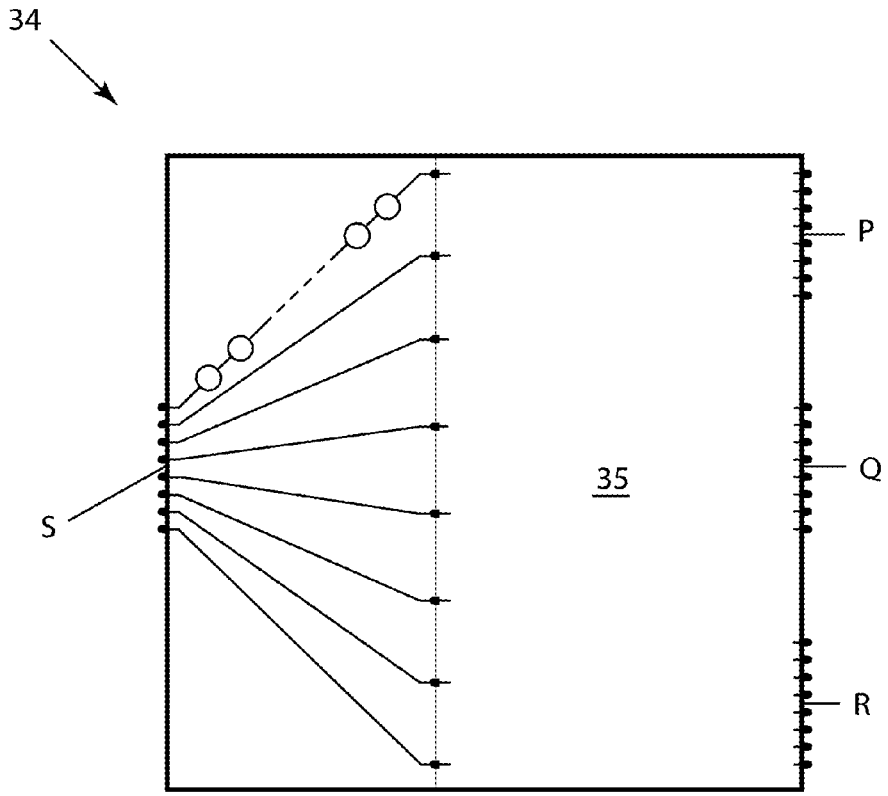
FIG. 4A is a schematic of an integrated LED lighting fixture flexibly configured by a switch array to be able to perform the functions of all four basic operational modes.

A second embodiment of an LED fixture 34 according to this invention is shown in FIG. 4A. Fixture 34 integrates all of the functions described by the set of basic building blocks and functions for a single series array of LEDs 21 in each fixture 20 as has just been described. Fixture 34 is an integrated fixture which is configurable using a switch array 35. Switch array 35 may be an array of manually-settable DIP switches.

Figures 4B, 4C:
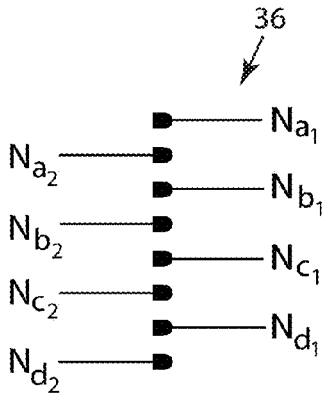
FIG. 4B is a table specifying the connections realized by the switch array in the fixture of FIG. 4A.
FIG. 4C provides a labeling legend to the operation of the switch array of FIG. 4A.

This second embodiment is illustrated schematically in FIGS. 4A-4C. FIG. 4A illustrates the basic structure, and FIG. 4C provides the necessary nomenclature for FIGS. 4A and 4B. The schematic representation is used to define the switch connections in a clear fashion; the corresponding physical array is not shown but is well-understood by those skilled in the art of circuit design. The functions of switch array 35 are defined in the table 38 of FIG. 4B. The four basic modes are achieved simply by setting the DIP switches according to the assignments in table 38 of FIG. 4B. Note that the input and output connectors of fixture 34 are labeled with the letters S and P, Q and R, respectively (instead of 34*i* and 34*o*1, 34*o*2 and 34*o*3, respectively, as is the case throughout this document), in order to simplify the terminology of table 38.

FIG. 4C presents a legend 36 to define the connection points of fixture 34 and the elements in table 38 defining switch array 35. The connection points labeled $N_{a1}$ through $N_{d1}$ are the eight connection points of a generic connector N. The various connectors and corresponding connection points or contacts follow the labeling terminology in table 38.

Figure 13:
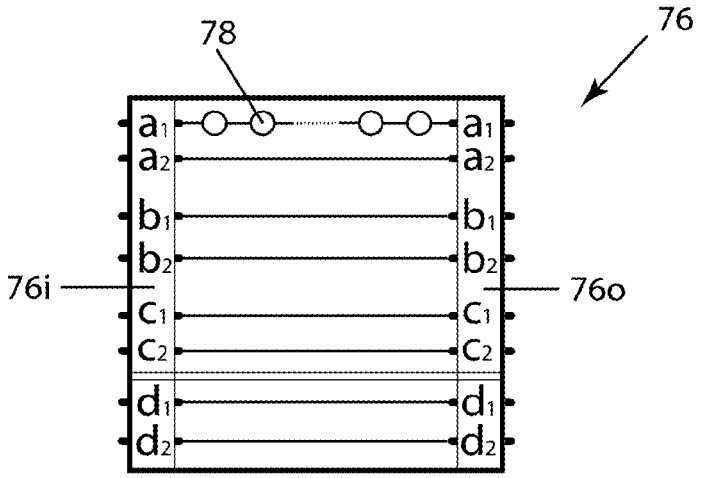
FIG. 13 is a schematic of a representative smart LED lighting fixture which utilizes one pair of cable conductors to carry data to control the LED lighting fixture and all other fixtures on the cable connected to this fixture, either directly or indirectly, as well as the low level of power required to power the electronic circuitry in the fixture.

A is variation of fixture 20, involves the addition of electronics into each fixture, indicated as fixture 76 in FIG. 13. Each such fixture 76 includes a single input connector 76*i* and a single output connector 76*o*. One pair of conductors, for example, pair $d_1d_2$ as shown in FIG. 13, is used to transmit data to each fixture in an array of fixtures along with the very small amount of power necessary to run the electronics (not shown) within each fixture 76. No manual intervention on the part of the installer is required; all electrical configuration of the system are carried out with an electronic array of switches similar to switch array 35 in FIG. 4A but controlled by a portion of power supply and controller 14 remotely-located from fixtures 76. Each fixture 76 contains an address established at the time of manufacture (or settable after manufacture), and control unit 14 is configured to "learn" the connectivity of the array of fixtures and be set according to the desires of the user.

These general embodiments do not form the complete set of alternatives but simply illustrate the possibilities which an LED lighting system with remote drivers and simple interconnection cabling and connectors may utilize.

Figure 5:
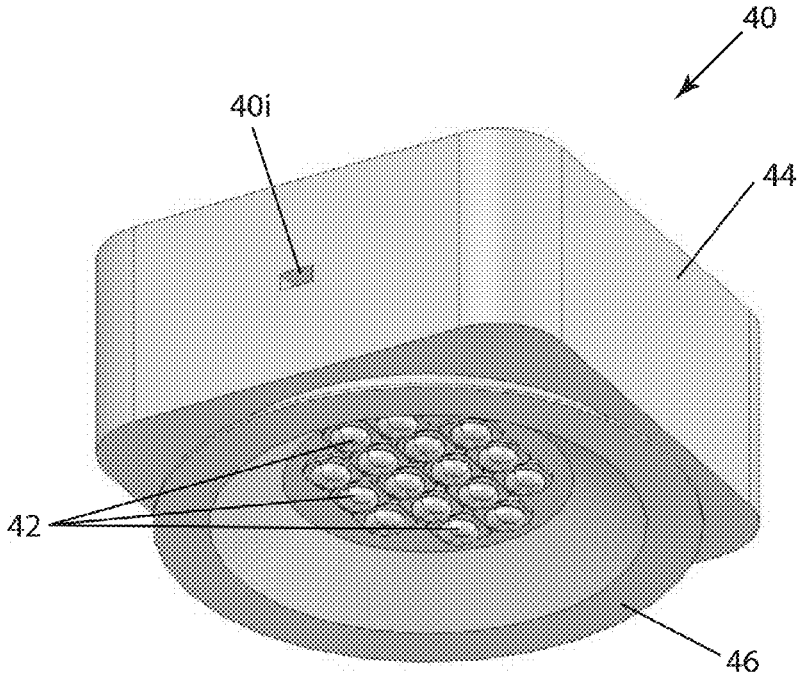
FIG. 5 is a perspective drawing of one embodiment of the inventive LED lighting fixture of this invention.
Figure 6:
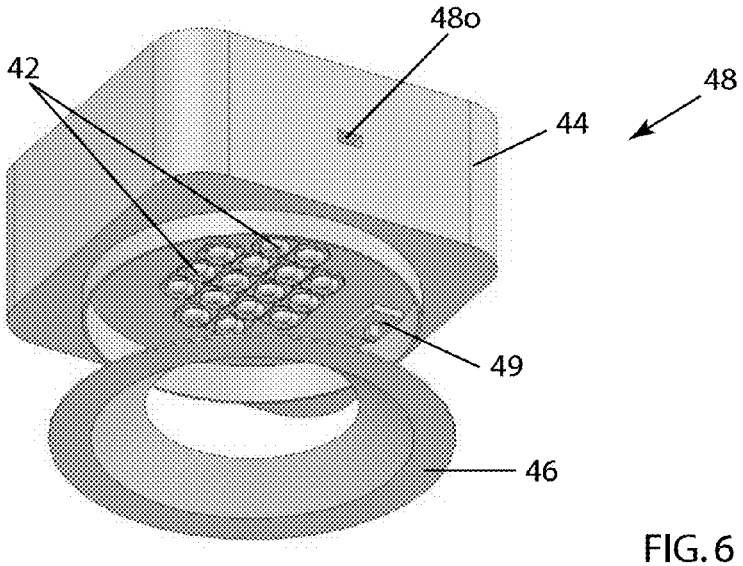
FIG. 6 is a perspective drawing of one alternative embodiment of the inventive LED lighting fixture of this invention.
Figure 7:
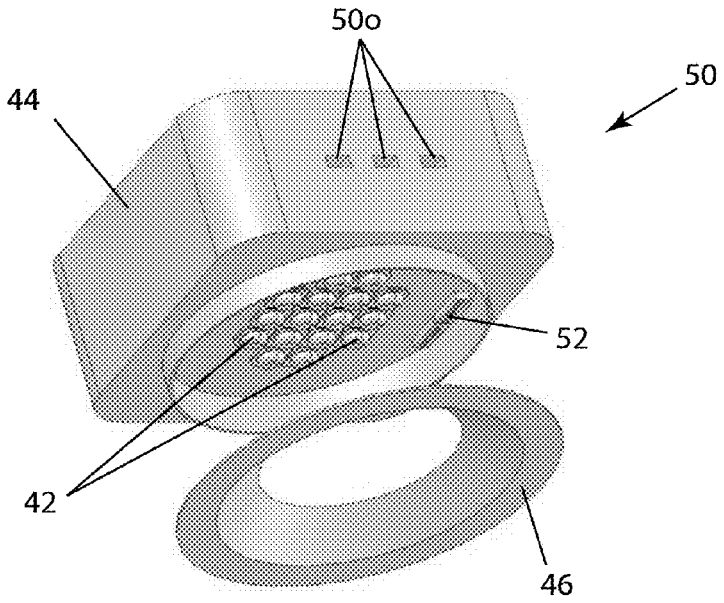
FIG. 7 is a perspective drawing of an integrated LED lighting fixture flexibly configured by a switch array to be able to perform the functions of all four basic operational modes.
Figure 8:
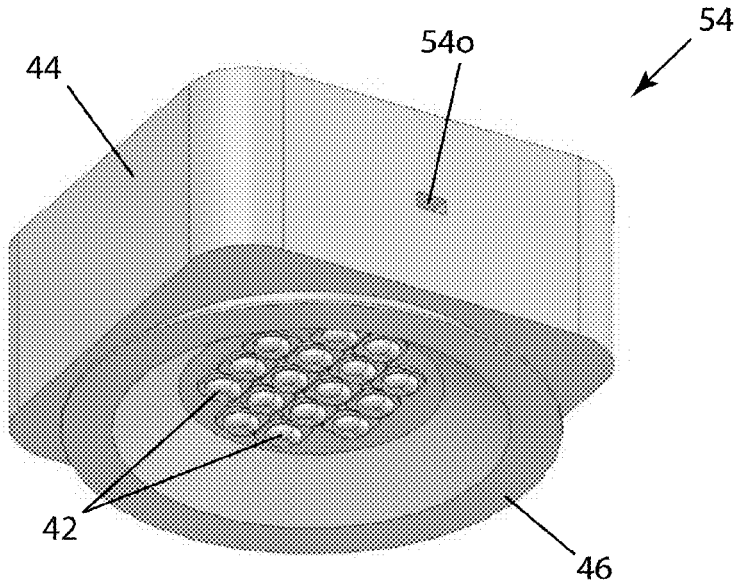
FIG. 8 is a perspective drawing of an automatically-configurable fixture having one pair of conductors for data.

FIGS. 5-8 present perspective representations of embodiments of recessed fixtures adapted for ceiling mounting and described schematically above. FIG. 5 simply shows a single input connector 40*i* (not shown in FIGS. 6 and 7) common to all three embodiments. FIG. 6 illustrates the first embodiment of an LED fixture including termination switch 49. FIG. 7 illustrates an embodiment of an integrated fixture 50 including a manually-settable DIP switch array 52. FIG. 8 illustrates a third embodiment including an output connector 54*o* in which one pair of conductors carries data to control an array of fixtures 54, of which only one is shown.

As mentioned above, FIG. 9 illustrates an example of an LED lighting system using the schematic functions to represent the various interconnections. Only single LED series fixtures are used in this simple example. The heavy bold lines 62 between elements represent communication network cabling. Control unit 10 has two "chains" 60*t* and 60*b* of fixtures being driven, top chain 60*t* utilizing all four pairs of conductors to drive LED fixtures 20 (three shown) and 28 (two shown), and the bottom chain 60*b* simply uses three of the driver channels to drive three fixtures 20. The LED fixtures in FIG. 9 are also labeled with letters A through H for simplicity.

Fixtures A and B are controlled as a group and are driven by $a_1a_2$ (in connector 18*a*) of top chain 60*t*. Fixture A is operating in Mode 1, and Fixture B is operating in Mode 3. Fixture C is driven and controlled by $b_1b_2$ of a top driver set 61*t* and is also operating in Mode 3. Fixtures D and E are driven by the driver and conductors connected to $c_1c_2$ and $d_1d_2$ of connector 18*a*, respectively, and are operating in Mode 2 as terminated fixtures 28. From a bottom set of drivers 61*b*, connected through connector 18*b*, fixtures F, G and H are each controlled by their own driver channels, as is clearly seen in FIG. 9. Fixtures F and G are operating in Mode 3, and fixture H is operating in Mode 2.

FIGS. 10-13 illustrate a few configurational variations which are possible within the inventive LED fixtures of this invention. Such variations provide even more flexibility to the lighting system architectures possible according to this invention. These configurations are not intended to limit the scope of the disclosure but to illustrate the wide range of possibilities which fit within the concepts upon which these configurations are based.

Figure 10:
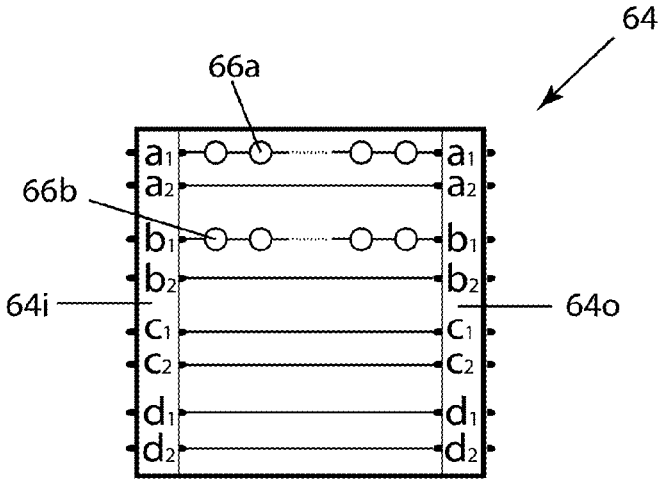
FIG. 10 is a schematic of a representative LED lighting fixture having two series-connected sets of LEDs, one connected to a first pair of driver lines and the other connected to a second set of driver lines.

FIG. 10 is a schematic of a representative LED fixture 64 which has LEDs 66*a* in series within the circuit of the driver and conductors (not shown) connected to $a_1a_2$ within the input connector 64*i* and output connector 64*o* and LEDs 66*b* in series within the circuit of the driver and conductors (not shown) connected to $b_1b_2$ within the input connector 64*i* and output connector 64*o*. Thus, two power drivers (not shown) are used to power LEDs 66*a* and 66*b* of fixture 64.

Figure 11:
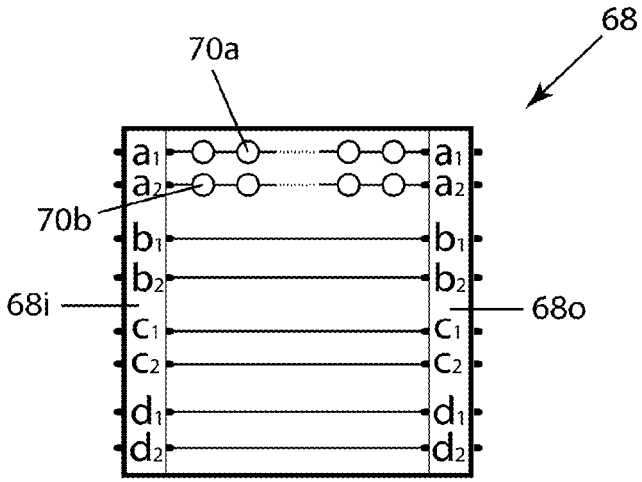
FIG. 11 is a schematic of a representative LED lighting fixture having parallel sets of series LEDS, in this case two sets, connected one each to the "in" and "out" lines of a driver conductor pair.

FIG. 11 is a schematic of a representative LED fixture 68 having parallel sets of series LEDS 70*a* and 70*b* connected one each to the "in" and "out" lines of a driver and conductor pair (not shown) connected to $a_1a_2$ of connectors 68*i* and 68*o*. For example, if the LEDs are to be driven at 350 milliamps (ma), then the driver must be capable of providing 700 ma to this conductor pair.

Figure 12:
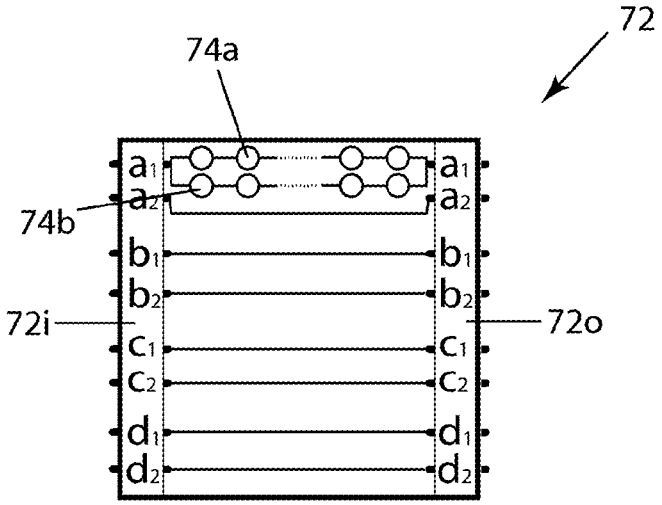
FIG. 12 is a schematic of a representative LED lighting fixture having two parallel sets of series LEDs, both of which are connected to the same conductor of a driver conductor pair.

FIG. 12 is a schematic of a representative LED fixture 72 having two parallel sets of series LEDs 74*a* and 74*b*, both of which are connected to the same conductor of a driver and conductor pair (not shown) connected to $a_1a_2$ of connectors 72*i* and 72*o*. The current considerations for fixture 68 shown in FIG. 11 apply to this configuration as well.

FIG. 13 is a schematic of a representative LED fixture 76 which utilizes one pair of cable conductors (the conductor pair connected to $d_1d_2$) to carry data to control LED fixture 76 and all other fixtures (not shown) on the cable connected to fixture 76, either directly or indirectly, as well as the low level of power required to power the electronic circuitry (not shown) in the fixture. Such a fixture is termed a "smart" fixture. The fixture contains a unique address, assigned during manufacture of the fixture electronics, which allows the onboard control circuitry, in conjunction with the controller in the control unit (located remotely), to individually control each fixture connected in an array of such fixtures.

While the principles of this invention have been described in connection with specific embodiments, it should be understood clearly that these descriptions are made only by way of example and are not intended to limit the scope of the invention.

The invention claimed is:

1. A low-voltage LED lighting fixture comprising:

at least one LED;

a standard network input connector having plural contact pairs;

at least one standard output connector having the same number of contact pairs as the input connector; and an interconnection network configured to flexibly change the interconnections between the input connector and the at least one output connector.

2. The low-voltage LED lighting fixture of claim 1 wherein the interconnection network is configured to (a) provide low-voltage power to the at least one LED and (b) connect each contact pair of the input connector to its corresponding contact pair of one output connector.

3. The low-voltage LED lighting fixture of claim 1 wherein the interconnection network is configured to (a) provide low-voltage power to the at least one LED and (b) short the conductors powering the LED.

4. The low-voltage LED lighting fixture of claim 3 wherein:

the fixture includes one fewer output connectors than the number of contact pairs of the input connector;

the input connector and each of the output connectors each have a primary contact pair, the primary contact pair of the input connector providing the power to the at least one LED; and the interconnection network is configured to (a) connect one non-primary pair of input connector contacts to the primary pair of output connector contacts on one output connector and (b) connect each remaining input connector contact pair only to a respective one of the remaining output connector contact pairs.

5. The low-voltage LED lighting fixture of claim 3 wherein:

the fixture includes one fewer output connectors than the number of contact pairs of the input connector;

the input connector and each of the output connectors each have a primary contact pair, the primary contact pair of the input connector providing the power to the at least one LED; and the interconnection network is configured to connect each non-primary input connector contact pair to a respective one of the primary pairs of an output connector.

6. The low-voltage LED lighting fixture of claim 1 wherein the LED lighting fixture is a recessed fixture adapted for ceiling mounting.

7. The low-voltage LED lighting fixture of claim 1 wherein the interconnection network is an array of switches.

8. The low-voltage LED lighting fixture of claim 7 wherein the switches of the array are DIP switches.

9. The low-voltage LED lighting fixture of claim 1 wherein one of the input connector contact pairs is connected to conductors which carry data to control the fixture and the interconnection network includes a unique address associated with the fixture.

10. The low-voltage LED lighting fixture of claim 1 wherein the at least one LED includes at least two LED subsets, each subset including at least one LED and being connected to a separate contact pair of the input connector.

11. The low-voltage LED lighting fixture of claim 10 wherein each LED subset includes a plurality of LEDs in series with one another.

12. The low-voltage LED fixture of claim 11 wherein the lighting fixture is a recessed fixture adapted for ceiling mounting.

13. A low-voltage LED lighting system including a plurality of power drivers and a plurality of LED lighting fixtures remote therefrom, at least one of the LED lighting fixtures comprising:

at least two subsets of LEDs, each subset having at least one LED;

a standard network input connector having plural contact pairs, each LED subset being connected to a separate one of the input-connector contact pairs;

at least one standard output connector having the same number of contact pairs as the input connector; and an interconnection network configured to flexibly change the interconnections between the input connector and the at least one output connector.

14. The low-voltage LED lighting system of claim 13 wherein each LED subset includes a plurality of LEDs in series with one another.

15. The low-voltage LED fixture of claim 14 wherein the lighting fixtured are recessed fixtures adapted for ceiling mounting.

16. A method of installing a low-voltage LED lighting system comprising:

providing at least one LED lighting fixture, each fixture having:

at least one LED;

a standard network input connector having plural contact pairs;

at least one standard output connector having the same number of contact pairs as the input connector; and an interconnection network configured to flexibly change the interconnections between the input connector and the at least one output connector;

providing at least one power driver;

installing the driver(s) at positions remote from the fixture (s); and interconnecting the fixture(s) and the driver(s) using communication network cabling and standard network connectors, thereby facilitating efficient lighting system installation with low man-hour requirements and low installer skill levels.

17. The installation method of claim 16 wherein the providing of fixture(s) is providing recessed fixture(s) adapted for ceiling mounting.

* * * * *

UNITED STATES PATENT AND TRADEMARK OFFICE

CERTIFICATE OF CORRECTION

PATENT NO. : 8,632,198 B2
APPLICATION NO. : 13/491123
DATED : January 21, 2014
INVENTOR(S) : Alan J. Ruud et al.

It is certified that error appears in the above-identified patent and that said Letters Patent is hereby corrected as shown below:

In the Specification

In column 8, line 13, delete the words "A is" and insert --A third embodiment, a--.

In the Claims

In claim 15, column 11, line 2, delete the word "fixtured" and insert --fixtures--.

Signed and Sealed this
Twenty-first Day of April, 2015

Michelle K. Lee

Michelle K. Lee
*Director of the United States Patent and Trademark Office*